US010337204B2

(12) United States Patent
Choi

(10) Patent No.: US 10,337,204 B2
(45) Date of Patent: Jul. 2, 2019

(54) TENT TOP FOLDING AND UNFOLDING STRUCTURE

(71) Applicant: Campvalley (Xiamen) Co., Ltd., Xiamen (CN)

(72) Inventor: Kwanjun Choi, KyoungNam (KR)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 14/998,549

(22) Filed: Dec. 24, 2015

(65) Prior Publication Data

US 2016/0289999 A1 Oct. 6, 2016

(30) Foreign Application Priority Data

Dec. 26, 2014 (CN) ..... 2014 2 0839641 U

(51) Int. Cl.
*E04H 15/48* (2006.01)
*E04H 15/32* (2006.01)

(52) U.S. Cl.
CPC ..... *E04H 15/48* (2013.01); *E04H 15/32* (2013.01)

(58) Field of Classification Search
CPC ..... E04H 15/48; E04H 15/52
See application file for complete search history.

(56) References Cited

U.S. PATENT DOCUMENTS 14,655 A 4/1856 Hartwell
58,283 A 9/1866 Palmer
379,274 A 3/1888 Hamilton
1,061,547 A 5/1913 Kennedy
1,129,194 A 2/1915 Hanley
1,347,107 A 7/1920 McCann
(Continued)

FOREIGN PATENT DOCUMENTS

CA 2 022 369 A1 2/1991
CN 1076987 A 10/1993
(Continued)

OTHER PUBLICATIONS

U.S. Appl. No. 14/221,087, filed Mar. 20, 2014.
U.S. Appl. No. 14/292,024, filed May 30, 2014.
U.S. Appl. No. 14/478,168, filed Sep. 5, 2014.

*Primary Examiner* — David R Dunn
*Assistant Examiner* — Danielle Jackson
(74) *Attorney, Agent, or Firm* — Morgan, Lewis & Bockius LLP

(57) ABSTRACT

A tent top folding and unfolding mechanism includes a connecting seat, a sliding seat, connecting rods, an elastic member and a bolt. The connecting seat is to be pivotally connected with tent top rods, and includes a sinking seat extending downward. The sliding seat is disposed below the connecting seat and movable in an upward and downward direction with respect to the connecting seat. The sliding seat includes an accommodating seat for receiving the elastic member. The sinking seat of the connecting seat has an inner diameter greater than an outer diameter of the accommodating seat to receive the accommodating seat. Each connecting rod has one end pivotally connected to a lower portion of the sliding seat and the other end to be pivotally connected to a corresponding tent top rod. The bolt passes through the connecting seat and the elastic adjustable member, and is fastened at the lower end.

9 Claims, 8 Drawing Sheets

(56) References Cited

U.S. PATENT DOCUMENTS

| | | | |
|---|---|---|---|
| 2,113,118 | A | 4/1938 | Pyatt |
| 2,227,554 | A | 1/1941 | Riordon |
| 2,306,706 | A | 12/1942 | Lucas |
| 2,448,895 | A | 9/1948 | Lawrence |
| 2,530,765 | A | 11/1950 | Greenup |
| 2,555,220 | A | 5/1951 | Brown |
| 2,716,993 | A | 9/1955 | Coderick |
| 2,731,972 | A | 1/1956 | Braun |
| 2,948,287 | A | 8/1960 | Rupert |
| 2,962,034 | A | 11/1960 | Finlayson |
| 2,984,249 | A | 5/1961 | Sears, Jr. et al. |
| 3,054,413 | A | 9/1962 | Eshelman |
| 3,333,373 | A | 8/1967 | Taylor et al. |
| 3,738,378 | A | 6/1973 | Williams |
| 3,810,482 | A | 5/1974 | Beavers |
| 3,929,146 | A | 12/1975 | Maiken |
| 4,077,417 | A | 3/1978 | Beavers |
| 4,148,332 | A | 4/1979 | Huddle |
| 4,201,237 | A | 5/1980 | Watts et al. |
| 4,280,521 | A | 7/1981 | Zeigler |
| 4,285,354 | A | 8/1981 | Beavers |
| 4,627,210 | A | 12/1986 | Beaulieu |
| 4,637,748 | A | 1/1987 | Beavers |
| 4,750,509 | A | 6/1988 | Kim |
| 4,787,182 | A | 11/1988 | Serge |
| 4,819,680 | A | 4/1989 | Beavers |
| 4,838,003 | A | 6/1989 | Zeigler |
| 4,941,499 | A | 7/1990 | Pelsue et al. |
| 4,944,321 | A | 7/1990 | Moyet-Ortiz |
| 4,971,090 | A | 11/1990 | Uhl |
| 4,998,552 | A | 3/1991 | Niksic et al. |
| 5,230,358 | A | 7/1993 | Forell |
| 5,263,507 | A | 11/1993 | Chuang |
| 5,293,890 | A | 3/1994 | Park et al. |
| 5,328,286 | A | 7/1994 | Lee |
| 5,333,634 | A | 8/1994 | Taylor |
| 5,361,794 | A | 11/1994 | Brady |
| 5,423,341 | A | 6/1995 | Brady |
| 5,617,681 | A | 4/1997 | Lyons |
| 5,628,338 | A | 5/1997 | Stumbo |
| 5,634,483 | A | 6/1997 | Gwin |
| 5,666,986 | A | 9/1997 | Fox |
| 5,701,923 | A | 12/1997 | Losi, Jr. et al. |
| 5,732,726 | A | 3/1998 | Lee |
| 5,771,651 | A | 6/1998 | Shiina |
| 5,797,695 | A | 8/1998 | Prusmack |
| 5,884,646 | A | 3/1999 | Ju |
| 5,943,837 | A | 8/1999 | Esser et al. |
| 6,021,795 | A | 2/2000 | Long et al. |
| 6,032,430 | A | 3/2000 | Soukup |
| 6,167,898 | B1 | 1/2001 | Larga et al. |
| 6,283,136 | B1 | 9/2001 | Chen |
| 6,286,530 | B1 | 9/2001 | Hussey |
| 6,296,415 | B1 | 10/2001 | Johnson et al. |
| 6,463,948 | B2 | 10/2002 | Lee |
| 6,516,823 | B1 | 2/2003 | Gioveret et al. |
| 6,591,571 | B2 | 7/2003 | Fritsche et al. |
| 6,604,844 | B2 | 8/2003 | Hussey |
| 6,666,223 | B2 | 12/2003 | Price et al. |
| 6,772,780 | B2 | 8/2004 | Price |
| 6,776,179 | B1 | 8/2004 | Chen |
| 6,854,476 | B1 | 2/2005 | Chai |
| 6,868,858 | B2 | 3/2005 | Suh |
| 6,874,519 | B2 | 4/2005 | Chiang |
| 6,892,744 | B2 | 5/2005 | Feldpausch et al. |
| 7,025,075 | B2 | 4/2006 | Suh |
| 7,040,585 | B2 | 5/2006 | Cheng et al. |
| 7,059,094 | B2 | 6/2006 | Yamawaki |
| D544,941 | S | 6/2007 | Rogers |
| 7,311,113 | B2 | 12/2007 | Suh |
| 7,316,239 | B2 | 1/2008 | Yang |
| 7,392,610 | B2 | 7/2008 | Jedlicka |
| RE40,544 | E | 10/2008 | Suh |
| 7,481,235 | B2 | 1/2009 | Prusmack |
| 7,546,845 | B2 | 6/2009 | Prusmack |
| 7,607,447 | B1 | 10/2009 | Han |
| 7,861,736 | B2 | 1/2011 | Choi |
| 8,047,218 | B1 | 11/2011 | Shin |
| 8,069,872 | B2 | 12/2011 | Bae |
| 8,469,045 | B2 | 6/2013 | Zhou |
| 8,485,208 | B2 | 7/2013 | Seo |
| D705,884 | S | 5/2014 | Jin |
| 8,910,648 | B2 | 12/2014 | Jin |
| 2001/0050098 | A1 | 12/2001 | Lee |
| 2003/0005953 | A1 | 1/2003 | Erbetta et al. |
| 2006/0016467 | A1 | 1/2006 | Bae |
| 2006/0269048 | A1 | 12/2006 | Choi |
| 2007/0051399 | A1 | 3/2007 | Jung |
| 2007/0215192 | A1 | 9/2007 | Hoffmann |
| 2012/0318316 | A1 | 12/2012 | Choi et al. |
| 2013/0014794 | A1 | 1/2013 | Jin |
| 2014/0076372 | A1 | 3/2014 | Jin |
| 2014/0109945 | A1 | 4/2014 | Jin |
| 2014/0246062 | A1 | 9/2014 | Ma |
| 2014/0261601 | A1 | 9/2014 | Jin |
| 2014/0290710 | A1 | 10/2014 | Choi |
| 2015/0068573 | A1 | 3/2015 | Jin |
| 2015/0083177 | A1 | 3/2015 | Hotes |
| 2015/0129008 | A1* | 5/2015 | Li ..... E04H 15/32 135/147 |
| 2015/0167343 | A1 | 6/2015 | Fang |

FOREIGN PATENT DOCUMENTS

| | | | |
|---|---|---|---|
| CN | 2506736 | Y | 8/2002 |
| CN | 2635827 | Y | 8/2004 |
| CN | 2697225 | Y | 5/2005 |
| CN | 201013097 | Y | 1/2008 |
| CN | 201103269 | Y | 8/2008 |
| CN | 201129060 | Y | 10/2008 |
| CN | 201220478761.4 | | 9/2012 |
| CN | 202767622 | U | 3/2013 |
| CN | 203034904 | U | 3/2013 |
| FR | 1 121 851 | | 8/1956 |
| FR | 68588 | | 5/1958 |
| GB | 2 201 703 | A | 9/1988 |
| GB | 2 259 927 | A | 3/1993 |
| KR | 10-2011-0054253 | A | 5/2011 |
| WO | WO 2011/022764 | A1 | 3/2011 |

* cited by examiner

TENT TOP FOLDING AND UNFOLDING STRUCTURE

CROSS REFERENCE TO RELATED APPLICATIONS

This application claims priority to Chinese Application No. 201420839641.1, filed Dec. 26, 2014, which is hereby incorporated by reference in its entirety.

TECHNICAL FIELD

The present invention relates to a tent, and more particularly, to a tent top folding and unfolding mechanism.

BACKGROUND ART

Tents or awnings are common leisure products prepared for outdoor use. However, as for a relatively large tent or awning, it requires several persons to unfold the tent or awning successfully due to its bulky size and heavy weight. Accordingly, various supporting structures have been designed to facilitate unfolding the tent or awning.

To solve the defects of an existing tent folding and unfolding mechanism, such as complicated parts and the scattered mechanism, the applicant has invented a mechanism disclosed in the Chinese Utility Model No. CN203034904. As shown in FIG. 1 and FIG. 2, a tent top folding and unfolding mechanism is disclosed, including a connecting seat 1', a sliding seat 2' that is flexibly disposed on the connecting seat 1', and an elastic adjustable member 3'. The elastic adjustable member 3' may be a spring or a cylinder. The middle portion of the connecting seat 1' extends downward to form an accommodating seat 12' for accommodating the elastic adjustable member. A sinking seat 21' whose outer diameter is greater than an outer diameter of the accommodating seat is formed at the upper portion of the sliding seat 2'. A bolt rod 7' successively passes upward through the sliding seat 2' and a lower end of the accommodating seat 12' from below the sliding seat, and is connected to a bolt cap 4' in a locked manner after passing through the elastic adjustable member 3'. The circumference at the lower portion of the sliding seat 2' is also provided with a pivotal connection slot 22', where the pivotal connection slot 22' is used to be pivotally connected to one end of a connecting rod 6' for supporting a tent top rod 6', and the other end of the connecting rod 6' is pivotally connected on the tent top rod 5; additionally, a fixing portion 23' is formed at a lower end of the sliding seat 2' to connect a tent cloth.

The accommodating seat 12' is provided on the connecting seat 1', so that the elastic adjustable member 3' is accommodated in the accommodating seat 12'; moreover, by means of the bolt rod 7' and the bolt cap 4', the elastic adjustable member 3' can be compressed and the sliding seat 2' is driven to move up and down, and by means of the connecting rod 6', the sliding seat 2' further drives the tent top rod 5' to fold and unfold, thereby achieving the function of assisting in folding and unfolding a tent.

The aforementioned tent top folding and unfolding mechanism is concise and simple in structure, and desirable in appearance integrity. However, in the aforementioned tent top folding and unfolding mechanism, there is a countersink at the top portion of the connecting seat, and therefore, the structure is not beautiful; moreover, if sundries fall into the countersink at the upper portion, use of the tent is affected, and practicability is undesirable.

SUMMARY OF THE INVENTION

An objective of the present invention is to provide a tent top folding and unfolding mechanism, which is concise and simple in structure and desirable in appearance integrity, and is more practical.

To achieve the foregoing objective, the present invention uses the following solution:

A tent top folding and unfolding mechanism includes a connecting seat pivotally connected to a tent top rod, a sliding seat that is located below the connecting seat and moves up and down with respect to the connecting seat, and an elastic adjustable member, where a connecting rod for being pivotally connected to the tent top rod and supporting the tent top rod is pivotally connected to the circumference at a lower portion of the sliding seat; an accommodating seat for accommodating the elastic adjustable member is formed on the sliding seat, the connecting seat extends downward to form a sinking seat that has an opening facing downward, and an aperture of the sinking seat is greater than an outer diameter of the accommodating seat located below the sinking seat; a bolt successively passes downward through the sinking seat and a lower end of the accommodating seat from the connecting seat, and is connected to a bolt cap in a locked manner after passing through the elastic adjustable member.

The elastic adjustable member is a spring or a cylinder.

A fixing block is arranged below the sliding seat, and a fixing portion for connecting a tent cloth is arranged below the fixing block.

An outer diameter of the bolt cap is less than an inner diameter of the accommodating seat and greater than an outer diameter of the elastic adjustable member.

Pivotal connection slots for being connected to the tent top rod are evenly arranged at the circumference of the connecting seat, and a connector is arranged at an inner end of the tent top rod and pivotally connected in the pivotal connection slot.

The circumference at the lower portion of the sliding seat is also provided with a pivotal connection slot for being pivotally connected to one end of the connecting rod, and the other end of the connecting rod is pivotally connected to the connector at the inner end of the tent top rod.

The bolt successively passes downward through the sinking seat and the elastic adjustable member from an external side of the connecting seat and reaches the bolt cap below the accommodating seat, and the elastic adjustable member is limited within the accommodating seat by the bolt and the bolt cap in coordination.

The circumference of the lower portion of the sliding seat is also provided with a pivotal connection slot for being pivotally connected to one end of the connecting rod, and the other end of the connecting rod is pivotally connected to the connector at the inner end of the tent top rod.

After the foregoing structure is used, in the present invention, a sliding seat is flexibly disposed below the connecting seat, so that an elastic adjustable member is accommodated in an accommodating seat of the sliding seat; by means of a bolt and a bolt cap, the elastic adjustable member can be compressed and the sliding seat is driven to move up and down; and by means of a connecting rod, the sliding seat further drives the tent top rod to fold and unfold, thereby achieving the function of assisting in folding and unfolding a tent. Therefore, the present invention is more concise in structure, and is desirable in appearance integrity. The bolt is limited after penetrating from top to bottom, to avoid providing a countersink at the top portion of the connecting seat, so that the whole folding and unfolding mechanism is more beautiful, and the problem that use of the tent is affected and the practicability is poor due to sundries falling into the countersink is avoided.

DESCRIPTION OF THE EMBODIMENTS

Figure 1:
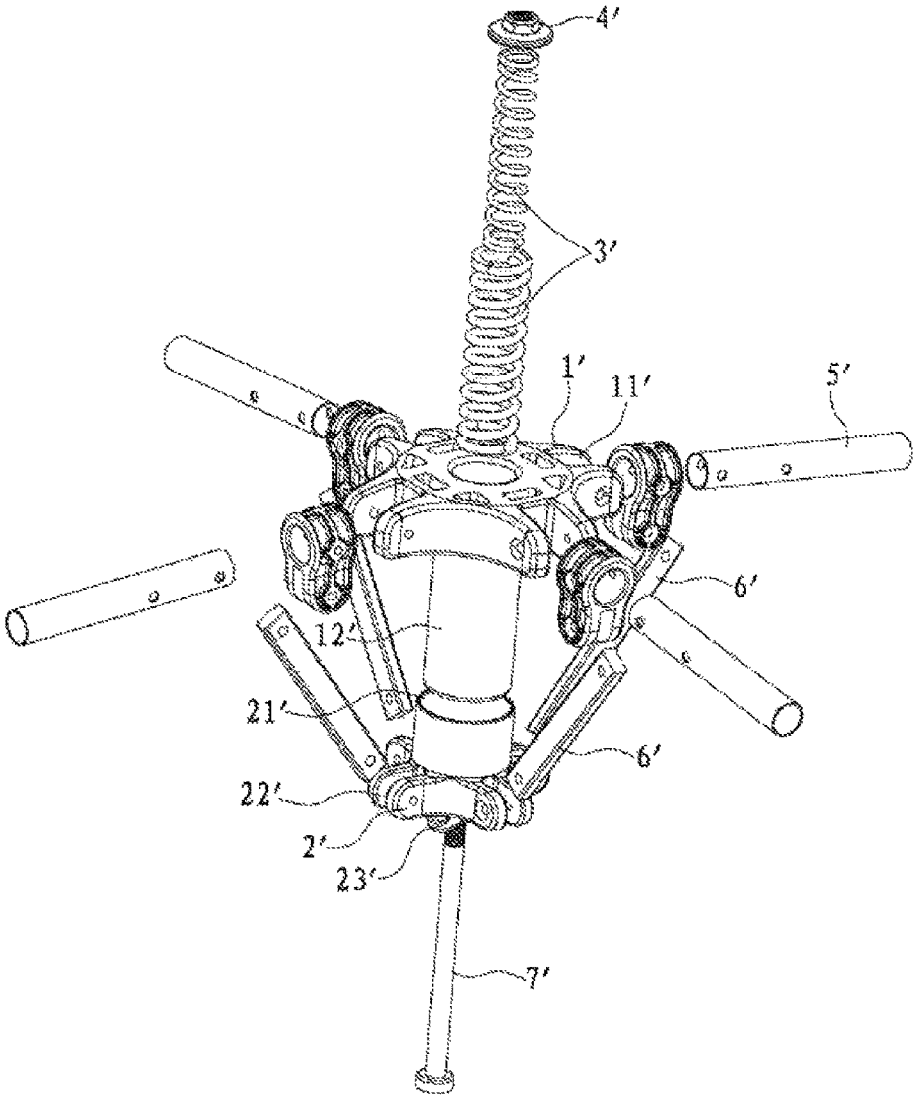
FIG. 1 (Related Art)
FIG. 1 is an exploded stereo view of an existing tent top folding and unfolding mechanism.
Figure 2:
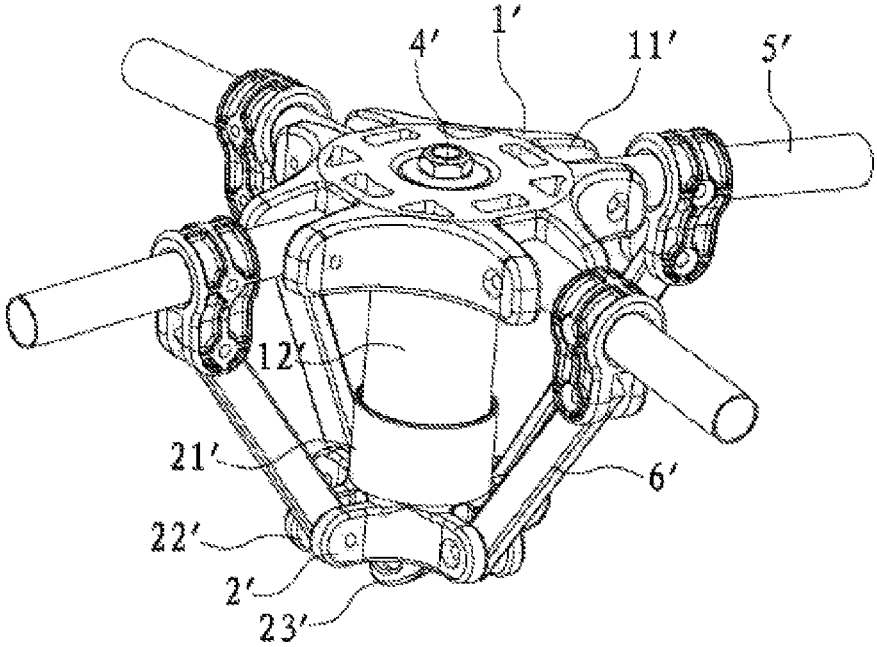
FIG. 2 (Related Art)
FIG. 2 is a schematic view of an unfolded state of an existing tent top folding and unfolding mechanism.
Figure 3:
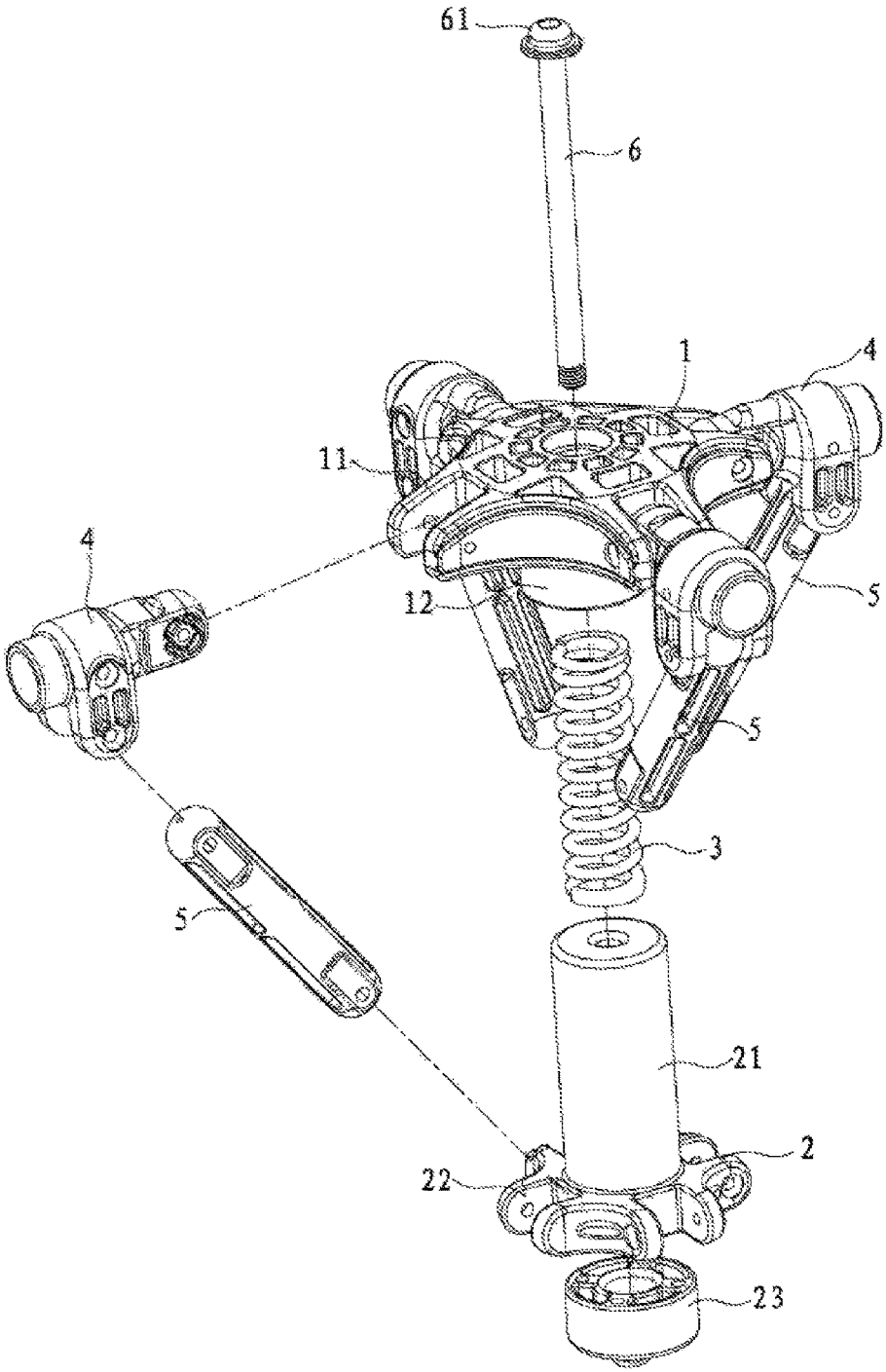
FIG. 3 is an exploded stereo view of the present invention.

To further illustrate the technical solution of the present invention, detailed descriptions of the present invention are provided below through a specific embodiment.

As shown in FIG. 3 to FIG. 6, a tent top folding and unfolding mechanism according to the present invention includes a connecting seat 1, a sliding seat 2 flexibly arranged below the connecting seat 1, and an elastic adjustable member 3; an accommodating seat 21 is formed above the sliding seat 2, and the accommodating seat 21 is located below the connecting seat 1.

Pivotal connection slots 11 are evenly arranged at the circumference of the connecting seat 1. This embodiment is described by using four pivotal connection slots 11 as an example. The pivotal connection slots 11 are used to connect a tent top rod (not shown in the figure). A connector 4 at an inner end of the tent top rod is shown in the figure, the tent top rod is connected in the connector 4, and the connector 4 is pivotally connected in the pivotal connection slot 11.

The middle portion of the connecting seat 1 extends downward to form a sinking seat 12 that has an opening facing downward. An aperture of the sinking seat 12 is greater than an outer diameter of the accommodating seat 21 located below the sinking seat 12. The accommodating seat 21 is used for accommodating an elastic adjustable member 3, and an opening of the accommodating seat 21 faces downward. The circumference at the lower portion of the sliding seat 2 is also provided with a pivotal connection slot 22. The pivotal connection slot 22 is used to be pivotally connected to one end of the connecting rod 5 that supports the tent top rod, and the other end of the connecting rod 5 is pivotally connected on the connector 4 at the inner end of the tent top rod.

The elastic adjustable member 3 may be a spring or a cylinder. An upper end of the elastic adjustable member 3 is limited within the accommodating seat 21. In this embodiment, the elastic adjustable member 3 is a spring, and the spring pushes downward. The elastic adjustable member 3 is limited within the accommodating seat 21 of the sliding seat 2 by a bolt 6 and a bolt cap 7 in coordination. An upper end of the bolt 6, that is, an end cap 61 at a tail portion, is limited on a top surface of the connecting seat 1. The bolt 6 successively passes downward through the sinking seat 12 and accommodating seat 21 from an external side of the connecting seat 1, to reach a position below the accommodating seat 21. The bolt cap 7 is located below the accommodating seat 21. A fixing block 23 is arranged below the sliding seat 2, and a fixing portion 24 is arranged below the fixing block 23 to connect a tent cloth.

Figure 4:
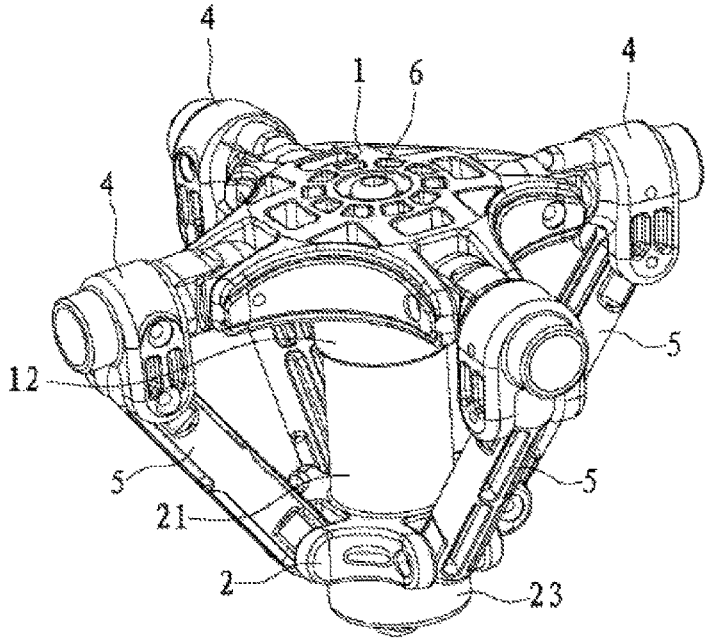
FIG. 4 is a schematic view of an unfolded state of the present invention.

As shown in the figures, during assembly, the elastic adjustable member 3 is disposed in the accommodating seat 21 of the connecting seat 1, and the sliding seat 2 is located below the accommodating seat 21 and is sleeved upward in the sinking seat 12. In this case, the bolt 6 successively passes downward through the sinking seat 12 and the lower end of the accommodating seat 21 from above the connecting seat 1, and is connected to the bolt cap 7 after passing through the elastic adjustable member 3. An outer diameter of the bolt cap 7 is less than an inner diameter of the accommodating seat 21 and greater than an outer diameter of the elastic adjustable member 3. In this case, the elastic adjustable member 3 is limited in the accommodating seat 21 by the bolt cap 7; then, the tent top rods are pivotally connected to the connecting seat 1 and the connecting rod 5, and the connecting rod 5 is further pivotally connected to the sliding seat 2; in this way, a tent top folding and unfolding mechanism is formed, as shown in FIG. 4.

Figure 5:
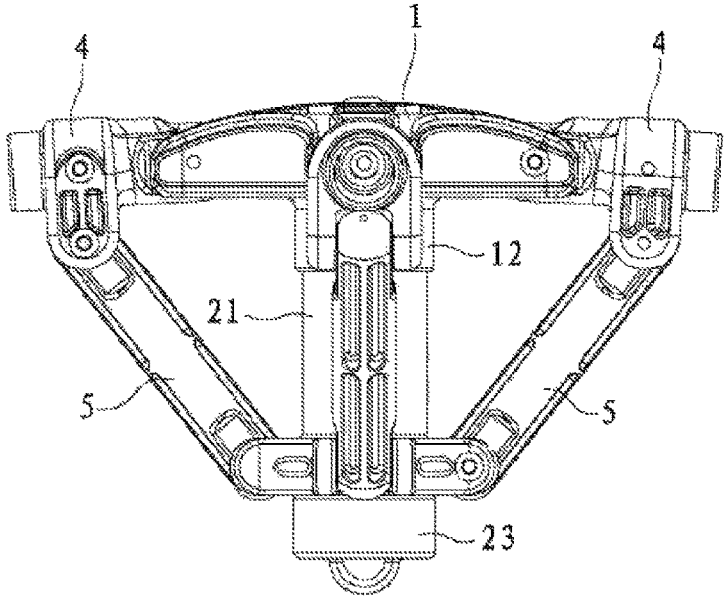
FIG. 5 is a side view of an unfolded state of the present invention.
Figure 6:
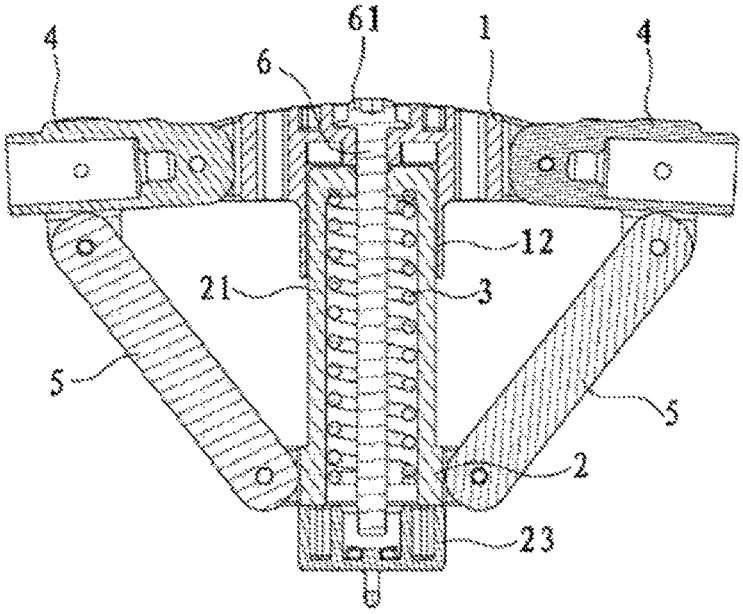
FIG. 6 is a sectional view of FIG. 5.

As shown in FIG. 5 and FIG. 6, when the elastic adjustable member 3 is in a normal state, that is, when the tent is in an unfolded state, the accommodating seat 21 in the sliding seat 2 is sleeved in the sinking seat 12 of the connecting seat 1, that is, a distance between the sliding seat 2 and the connecting seat 1 is shortest.

Figure 10:
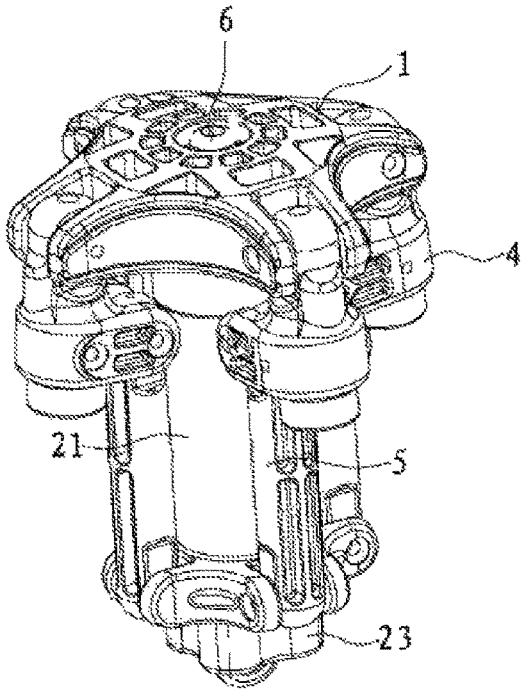
FIG. 10 is a schematic view of a folded state of the present invention.
Figure 11:
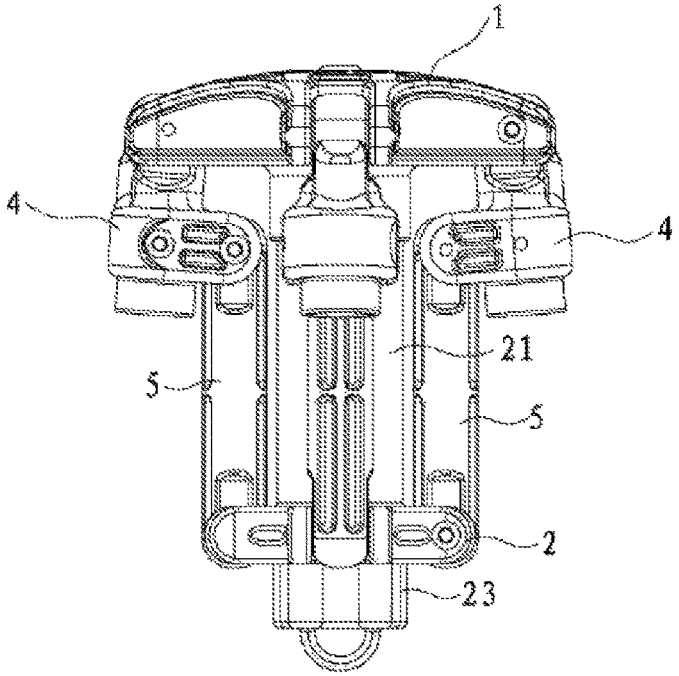
FIG. 11 is a side view of a folded state of the present invention.
Figure 12:
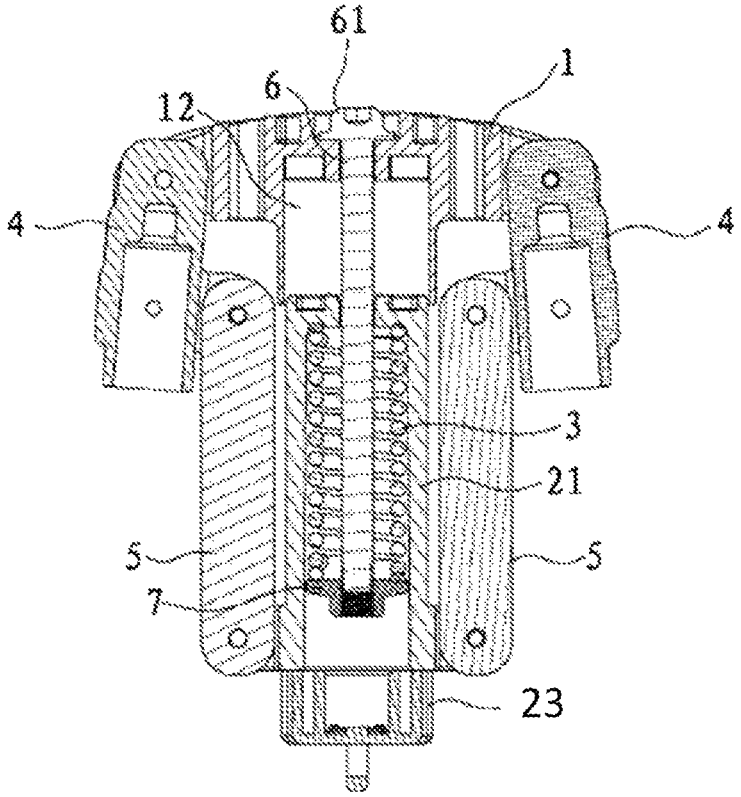
FIG. 12 is a sectional view of FIG. 11.

During implementation, normally, when the tent is in a folded state, as shown in FIG. 10 to FIG. 12, the tent top rods are folded together under the effect of a force. In this case, the connecting rod 5 is folded in a manner of being parallel to the sliding seat 2 and accommodating seat 21; the sliding seat 2 and the accommodating seat 21 escape from the coordination with the sinking seat 12 and are located below connecting seat 1. Under the traction of the sliding seat 2, the bolt 6, together with the bolt 7, moves downward with respect to the connecting seat 1, and in this case, being pressed by the bolt cap 7, the elastic telescopic member 3 is in a compressed energy storage state.

Figure 7:
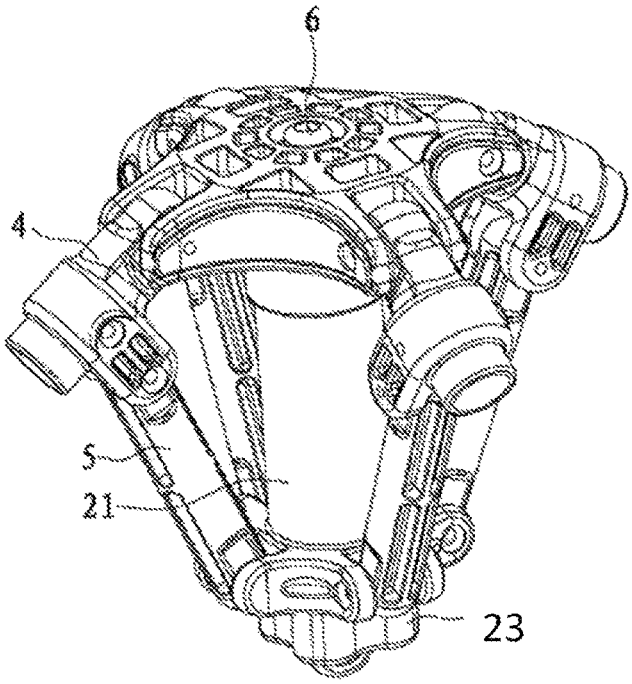
FIG. 7 is a schematic view of a folding action of the present invention.
Figure 8:
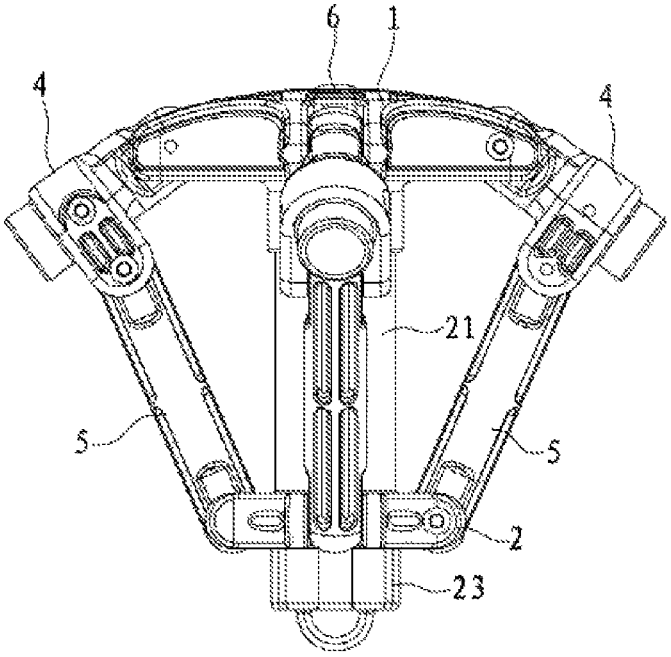
FIG. 8 is a side view of a folding action of the present invention.
Figure 9:
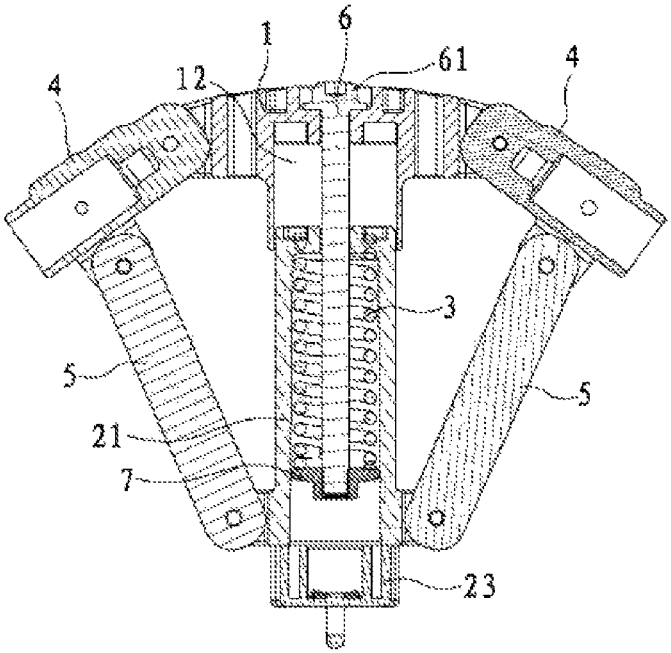
FIG. 9 is a sectional view of FIG. 8.

When the tent needs to be unfolded, as shown in FIG. 7 to FIG. 9, a centralizing force on the tent top rods is released, so that the tent top rods are in a released state; under the effect of a restoring force of the elastic adjustable member 3, the bolt cap 7 pulls the bolt 6 to move upward, and at the same time drives the sliding seat 2 to move upward with respect to the connecting seat 1. The accommodating seat 21 returns into the sinking seat 12. Due to a pivotal connection relationship of the connecting rod 5 with the sliding seat 2 and the tent top rods, in an upward moving process, the sliding seat 2 can push the tent top rods outward, as shown in FIG. 4 and FIG. 6, thereby achieving the function of assisting in unfolding the tent.

In conclusion, in the present invention, a sliding seat 2 is flexibly disposed below the connecting seat 1, so that an elastic adjustable member 3 is accommodated in an accommodating seat 21 of the sliding seat 2; by means of a bolt 6 and a bolt cap 7, the elastic adjustable member 3 can be compressed and the sliding seat 2 is driven to move up and down; and by means of a connecting rod 5, the sliding seat 2 further drives the tent top rod to fold and unfold, thereby achieving the function of assisting in folding and unfolding a tent. Therefore, the present invention is more concise in structure, and is desirable in appearance integrity. The bolt 6 is limited after penetrating from top to bottom, to avoid providing a countersink at the top portion of the connecting seat, so that the whole folding and unfolding mechanism is more beautiful, and the problem that use of the tent is affected and the practicability is poor due to sundries falling into the countersink is avoided.

The foregoing embodiment and drawings are not intended to limit the product model and pattern of the present invention, and any proper change or modification made by those of ordinary skill in the art should not be considered as departing from the patent scope of the present invention.

The invention claimed is:

1. A tent top folding and unfolding mechanism, comprising:

a connecting seat comprising a first hole, a plurality of first pivotal connection slots and a sinking seat, wherein the first hole is formed at a central top of the connecting seat and extends to the sinking seat, each first pivotal connection slot in the plurality of first pivotal connection slots comprises a pair of side walls at an upper portion of the connecting seat and extending radially, and the sinking seat extends downward to a lower portion of the connecting seat and beyond the plurality of first pivotal connection slots, and has an opening facing downward;

a sliding seat disposed below the connecting seat and movable in an upward and downward direction with respect to the connecting seat, the sliding seat comprising an accommodating seat and a second hole, wherein the sinking seat of the connecting seat has an inner diameter greater than an outer diameter of the accommodating seat to receive the accommodating seat, and the second hole is formed at a central top of the accommodating seat;

a plurality of connectors, each having one end disposed in a corresponding first pivotal connection slot in the plurality first pivotal connection slots and pivotally connected to the pair of walls of the corresponding first pivotal connection slot, and another end configured to connect with a tent top rod;

a plurality of connecting rods, each having one end pivotally connected to a lower portion of the sliding seat and another end pivotally connected to a corresponding connector in the plurality of connectors;

an elastic adjustable member received in the accommodating seat of the sliding seat; and a bolt passing through the first hole of the connecting seat, the second hole of the accommodating seat and the elastic adjustable member, wherein the bolt has an upper end fixed with the connecting seat and a lower end fastened.

2. The tent top folding and unfolding mechanism of claim 1, wherein: the elastic adjustable member comprises a spring or a cylinder.

3. The tent top folding and unfolding mechanism of claim 1, further comprising:

a fixing block disposed below the sliding seat, and comprising a fixing portion for connecting a tent cloth being arranged below the fixing block.

4. The tent top folding and unfolding mechanism of claim 1, wherein: the bolt is fastened at the lower end by a bolt cap, wherein an outer diameter of the bolt cap is less than an inner diameter of the accommodating seat and greater than an outer diameter of the elastic adjustable member.

5. The tent top folding and unfolding mechanism of claim 1, wherein: the bolt successively passes downward through the sinking seat and the elastic adjustable member from an external side of the connecting seat and fastened by a bolt cap below the elastic adjustable member, the elastic adjustable member being limited within the accommodating seat by the bolt and the bolt cap in coordination.

6. The tent top folding and unfolding mechanism of claim 1, wherein the plurality of first pivotal connection slots is evenly distributed circumferentially at the connecting seat.

7. The tent top folding and unfolding mechanism of claim 1, wherein the sliding seat is formed with a plurality of second pivotal connection slots at the lower portion of the sliding seat, wherein the one end of each connecting rod is pivotally connected to a corresponding second pivotal connection slot, and the other end of each connecting rod is connected to the connector at the inner end of the corresponding tent top rod.

8. The tent top folding and unfolding mechanism of claim 7, wherein the plurality of second pivotal connection slots is evenly distributed circumferentially at the lower portion of the sliding seat.

9. The tent top folding and unfolding mechanism of claim 1, wherein the bolt is fastened at the lower end by a bolt cap, and wherein the elastic adjustable member has an upper end abutting an upper end of the accommodating seat, and a lower end abutting the bolt cap.

* * * * *